United States Patent [19]

Callanan

[11] 4,226,416

[45] Oct. 7, 1980

[54] BASKETBALL PRACTICE ASSEMBLY

[76] Inventor: Robert F. Callanan, 2359 Chestnut Ave., Long Beach, Calif. 90806

[21] Appl. No.: 47,286

[22] Filed: Jun. 11, 1979

[51] Int. Cl.[3] ..... A63B 63/08

[52] U.S. Cl. ..... 273/1.5 A

[58] Field of Search ..... 273/1.5 A

[56] References Cited

U.S. PATENT DOCUMENTS

| | | | |
|---|---|---|---|
| 2,039,794 | 5/1936 | Hayden | 273/1.5 A |
| 2,708,576 | 5/1955 | Verkuilen | 273/1.5 A |
| 3,342,486 | 9/1967 | Farley | 273/1.5 A |

*Primary Examiner*—Paul E. Shapiro

[57] ABSTRACT

A basketball practice assembly that may be removably secured to a back board supported hoop in a desired position to assist a player in improving his ability to make successful free throws or side shots. The practice assembly is of such design that two of them may be oppositely positioned on side portions of a basketball hoop to permit two players to simultaneously practice side shots.

4 Claims, 7 Drawing Figures

FIG. 1
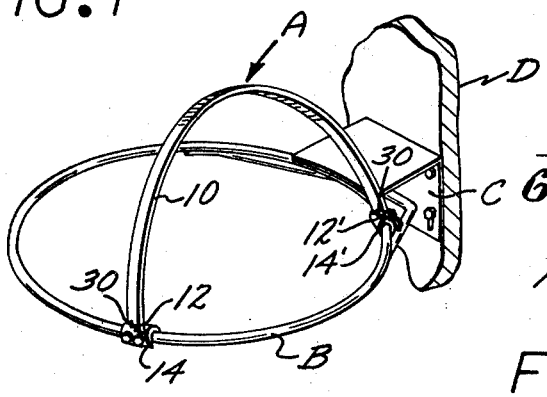
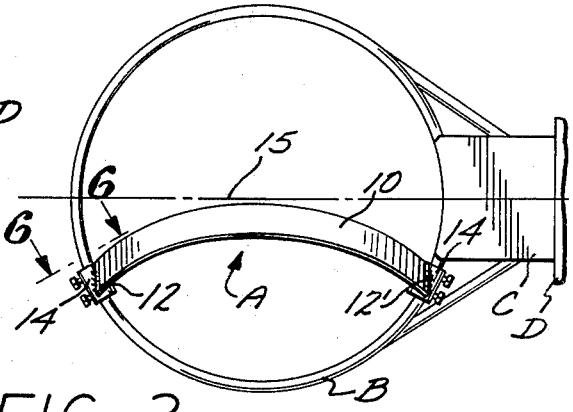
FIG. 2
FIG. 3
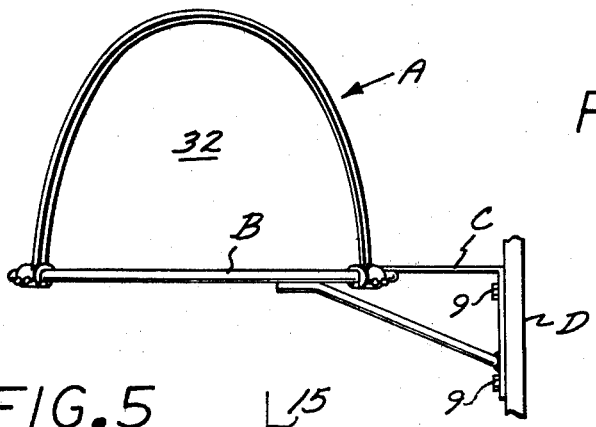
FIG. 4
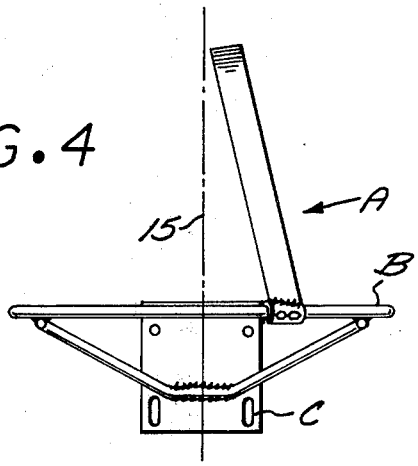
FIG. 5
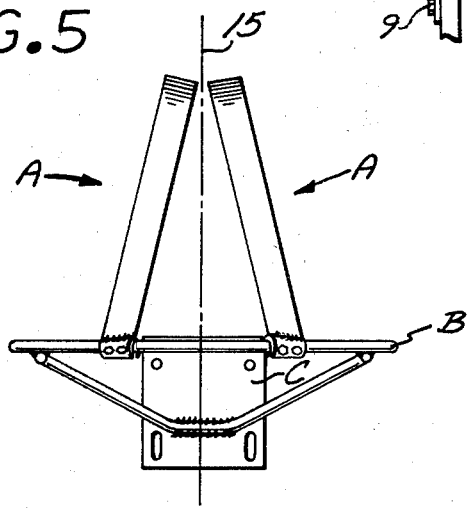
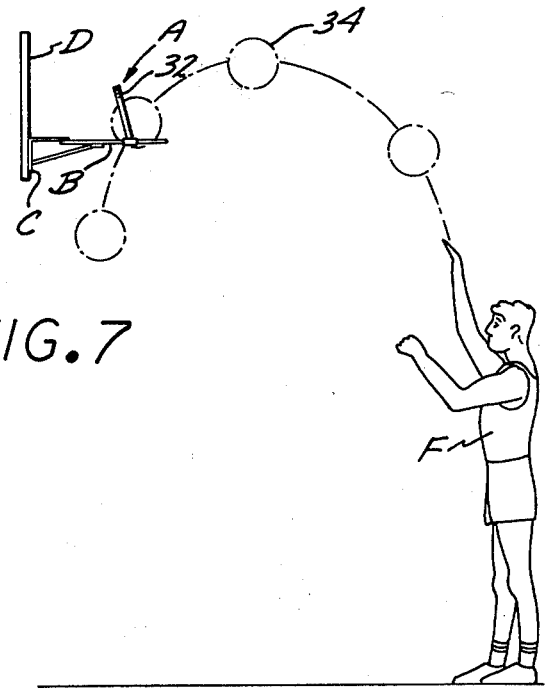
FIG. 7
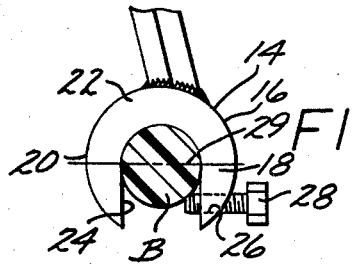
FIG. 6

BASKETBALL PRACTICE ASSEMBLY

BACKGROUND OF THE INVENTION

1. Field of the Invention

Basketball Practice Assembly.

2. Description of the Prior Art

The game of basketball requires a high degree of skill, and as a player in many instances is making a shot some distance from the basket and is looking at the hoop thereof substantially edge on, but to score the player must direct the basketball downwardly through a circular vertical opening he cannot see.

A major object of the present invention is to supply a practice assembly that is removably secured to a back board supported basketball hoop, and cooperates with the hoop to define an upwardly extending generally semi-elliptical space that serves as a target.

The practice assembly is so related to the hoop on which it is removably supported that the player is successful in scoring a basket if the basketball is so arched as to move through the semi-elliptical space. If the ball so moves through the semi-elliptical space it is certain of moving downwardly through the hoop for the player to score.

The practice assembly not only establishes in practice a vertical area at which the player aims to acquire a scoring shot, but after the assembly is removed from the hoop, the metal image of the assembly remains in the player's mind and acts as a target at which he shoots relative to the basket to secure a scoring shot.

SUMMARY OF THE INVENTION

The invention includes an arcuate rigid member, preferably of rectangular transverse cross section, that has the free ends thereof removably secured to clamps that have upwardly extending slots formed therein that permit the clamps to extend downwardly over sections of a basketball hoop. The rigid arcuate member so supported is of generally semi-elliptical shape and extends upwardly and inwardly towards the center of the hoop, but with no portion of the arcuate member extending beyond the center of the hoop. The clamps that support the arcuate shaped member are removably held on the hoop by screws or other fastening means that extend through tapped bores in the clamp, and with these screws being disposed below the circumferentially extending center line of the hoop, to assure that the basketball practice assembly will not be inadvertently displaced therefrom by being struck forceably with a basketball during practice. The assembly by loosening the screws may be adjusted to any desired position on the basketball hoop, such as directly forwardly from the backboard to permit practicing the free shots, or located on the sides of the hoop to permit any player to practice side shots. When the practice assembly is mounted on the side of a hoop, a second assembly may be mounted directly opposite on the hoop, to permit two players to concurrently practice side shots. When the practice assembly is not in use, it is easily removed from the supporting hoop, and stored in a convenient location until again needed.

BRIEF DESCRIPTION OF THE DRAWING

FIG. 1 is a perspective view of a back board supported basketball hoop, with the basketball practice assembly removably mounted thereon;

FIG. 2 is a top plan view of the basketball practice assembly shown in FIG. 1 and mounted on a backboard supported basketball hoop;

FIG. 3 is a side elevational view of the basketball practice assembly removably supported on a basketball hoop;

FIG. 4 is an end elevational view of the basketball practice assembly mounted on a back board supported basketball hoop;

FIG. 5 is an end elevational view of a basketball practice assembly as shown in FIG. 4, but with a second assembly mounted on the hoop to permit two players to concurrently practice basketball side shots;

FIG. 6 is an enlarged end elevational view of one of the clamps that form a part of the basketball practice assembly, and the bolt that is utilized in removably holding it in position on a basketball hoop; and FIG. 7 is a view of the basketball practice assembly in position on a backboard supported basketball hoop and illustrating the manner in which a player utilizes the assembly to arch a basketball to pass through the practice device and then fall downwardly through the hoop on which it is supported.

DESCRIPTION OF THE PREFERRED EMBODIMENT

The basketball practice assembly A, as may best be seen in FIGS. 1 and 2, is removably mounted on a basketball hoop B of conventional design that is supported by an L-shape racquet C from a back board D by a bolt 9 that extends through the bracket to engage the back board.

The basketball practice assembly includes an arcuate shaped rigid member 10, preferably formed from strapped steel or the like, that is of transverse rectangular cross section, and has first and second free ends 12 and 12'. First and second clamps 14 and 14' are provided with each clamp having one of the free ends 12, 12' of the arcuate member 10 secured thereto as may best be seen in FIG. 1. The arcuate member 10 when so secured extends upwardly above the clamp and inwardly therefrom. The inward inclination of the arcuate member 10 when supported from the clamp must not be so great that it will extend inwardly beyond the center line 15 of the hoop B.

In FIG. 6 it will be seen that each of the clamps 14 and 14' is formed from a relatively heavy rigid body 16 that has first and second laterally spaced parallel legs 18 and 20, with the legs on their upper portion merging into a transverse web 22. The first legs 18, as seen in FIGS. 6 and 2, has two spaced bolts 28 that extend inwardly through tapped bores formed in the first leg 18. The first and second legs 18 and 20 cooperate to define a vertical slot therebetween that in a horizontal direction has the same radius of curvature as the hoop B. The width of the slot 24 is such that it snugly engages a section of the hoop B. The bolts 28 utilized in removably supporting the first and second clamps 14 and 14' engage tapped bores 26, with the tapped bores 26 being located below the center line 29 of hoop B, to prevent the clamps being inadvertently displaced from the hoop should the arcuate member 10 be struck with a forceful blow from the arched basketball 32. The free ends 12 and 12' of the arcuate member 10 are secured to the upper portions of the first and second clamps 14 and 14' by welding beads 30 as illustrated in FIGS. 1 and 5. In FIG. 2 it will be seen that the first and second clamps 14 and 14' are spaced from one another a substantial less distance than the internal diameter of the basketball hoop B.

In use, the basketball assembly A may be disposed as shown in FIG. 7 directly in front of the backboard D to permit a player F to practice free throw shots with a basketball 32. When the invention is mounted on the hoop B as shown in FIG. 3 it will be seen that the hoop cooperates with the practice assembly A to define an upwardly extending generally semi elliptical space 32 that serves as the target area in which the player F directs the basketball 32. In FIG. 5 two of the practice assemblies A are arranged to permit concurrent practicing of side shots by two different players.

The use and operation of the invention has been previously described in detail and need not be repeated.

What is claimed is:

1. In combination with an elevated horizontal basketball hoop that extends forwardly from a vertical back board, a practice assembly that may be removably secured to said hoop to improve the accuracy of a user in arching a basketball through said hoop, said practice assembly including:

a. a dimensionally stable arcuate member of generally semi-elliptical shape that has first and second free ends that are spaced from one another a distance substantially less than the interior diameter of said hoop;

b. first and second clamps of inverted U-shape transverse cross-section that may extend downwardly over circumferentially spaced sections of said hoop;

c. first means for permanently affixing said first and second free ends of said arcuate member to said first and second clamps in such a manner that said arcuate member extends upwardly above said hoop and inwardly towards the center thereof, said arcuate member and hoop cooperating to define a generally semi-elliptical upwardly extending space of substantially greater area than the transverse cross section of a conventional basketball, and said upwardly extending space so related to the space within said hoop that said basketball will fall downwardly through said hoop by gravity if it passes through said upwardly extending space; and d. second means mounted on said first and second clamps for removably holding said clamps on said hoop, with said second means permitting said practice device to be selectively disposed of either directly in front of said backboard to practice free throws or at an angle of up to ninety degrees to the right or left thereof to practice side shots.

2. A basketball practice assembly as defined in claim 1 in which said arcuate member and first and second clamps are metal, and said first means are welding beads.

3. A basketball practice assembly as defined in claim 2 in which each of said clamps is of U-shape transverse cross-section in which a vertically extending slot is formed that has substantially the same radii of curvature as said hoop, said slots snugly and removably engaging circumferentially spaced sections of said hoop, and said second means being at least two bolts that extend through transverse tapped bores in each of said clamps to pressure contact a section of said hoop below the circumferential center line thereof.

4. A basketball practice assembly as defined in claim 3 in which said assemblies are of such size as to be concurrently supported on opposite sides of said hoop to permit two players to simultaneously practice side shots.

* * * * *